United States Patent [19]

Schaevitz

[11] Patent Number: 5,022,622

[45] Date of Patent: Jun. 11, 1991

[54] SUPPORT FOR THE BODY OF A WORKER

[76] Inventor: Lester P. Schaevitz, 431 Latches La., Merion Station, Pa. 19066

[21] Appl. No.: 464,294

[22] Filed: Jan. 12, 1990

[51] Int. Cl.[5] ..... A47B 96/00

[52] U.S. Cl. ..... 248/231.7; 182/230; 248/118

[58] Field of Search ..... 248/231.7, 345.1, 118, 248/118.1, 118.3, 118.5, 231.8; 24/335; 128/78; 182/230

[56] References Cited

U.S. PATENT DOCUMENTS

| | | | |
|---|---|---|---|
| 1,146,676 | 7/1915 | Weed | 297/195 U X |
| 2,518,107 | 8/1950 | Wilson | 182/230 X |
| 2,751,950 | 6/1956 | Scott | 248/231.8 X |
| 3,193,232 | 7/1965 | Hatcher | 248/231.8 |
| 3,300,250 | 1/1967 | Dollgener et al. | 248/118 X |
| 4,458,784 | 7/1984 | Holmes, Jr. | 182/230 |
| 4,493,393 | 1/1985 | Serber | 182/230 |
| 4,570,803 | 2/1986 | Peterson | 248/118 X |
| 4,681,370 | 7/1987 | Vancil | 248/118 X |
| 4,708,183 | 11/1987 | Figueroa | 248/231.7 X |
| 4,846,803 | 7/1989 | Emerson | 248/231.7 X |
| 4,903,923 | 2/1990 | Hoffman | 248/231.7 X |
| 4,907,772 | 3/1990 | Willinger | 248/231.7 |

*Primary Examiner*—Ramon O. Ramirez
*Attorney, Agent, or Firm*—Paul & Paul

[57] ABSTRACT

A support for a worker is provided, wherein a clamp allows for connection to a work surface and a spring member sets off a pad for a worker to lean against.

8 Claims, 3 Drawing Sheets

SUPPORT FOR THE BODY OF A WORKER

BACKGROUND OF THE INVENTION

This invention relates to supports for workers. More particularly, this invention relates to a support to be mounted against a work surface for a worker to lean against.

An individual who works before a table or desk, whether seated or standing, may over a period of time become fatigued. The individual who works seated before a desk, for example, may lean on his arms for support as he works, and thus experience fatigue in his arms from the pressure of his body upon his arms. As another example, an individual who works standing may take the entire pressure of his body only upon his feet, and thus experience fatigue over a period of time.

Therefore, a support would be desirable, which would be easily placed on a work surface, which would be non-obtrusive, and which would absorb pressure from a worker and thus lessen the possibility of fatigue.

It is an object of the present invention to provide a support for a worker.

It is a further object of the invention to provide a support for a worker that is non-obtrusive, i.e., that will not overly intrude on the work surface.

It is a further object of the present invention to provide a support for a worker that is simple and easy to manufacture.

DESCRIPTION OF THE PREFERRED EMBODIMENTS

Figure 1:
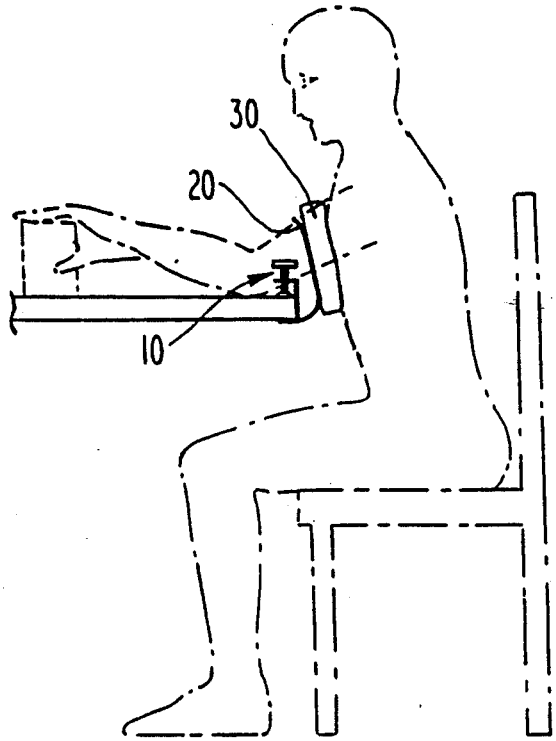
FIG. 1 illustrates a perspective view of a seated worker utilizing a preferred embodiment.

FIG. 1 illustrates a seated worker utilizing a preferred embodiment.

Figure 2:
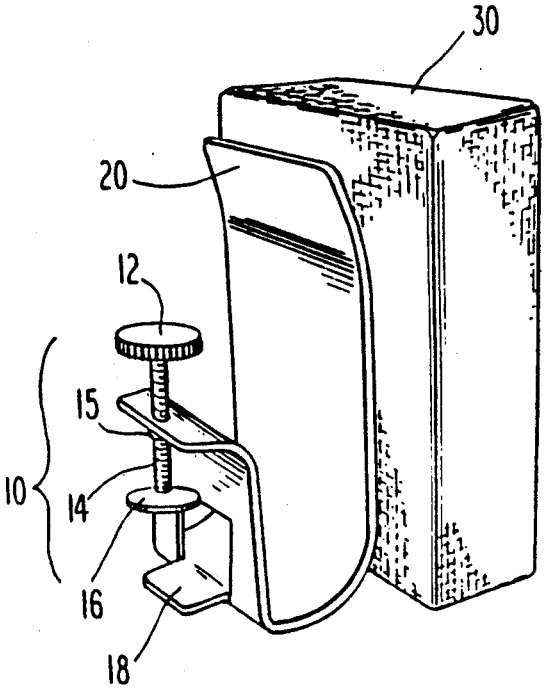
FIG. 2 illustrates a perspective view of a preferred embodiment.

FIG. 2 shows that preferred embodiment in perspective view. A clamp utilized in affixing the embodiment to the work surface is shown generally at 10.

Figure 3:
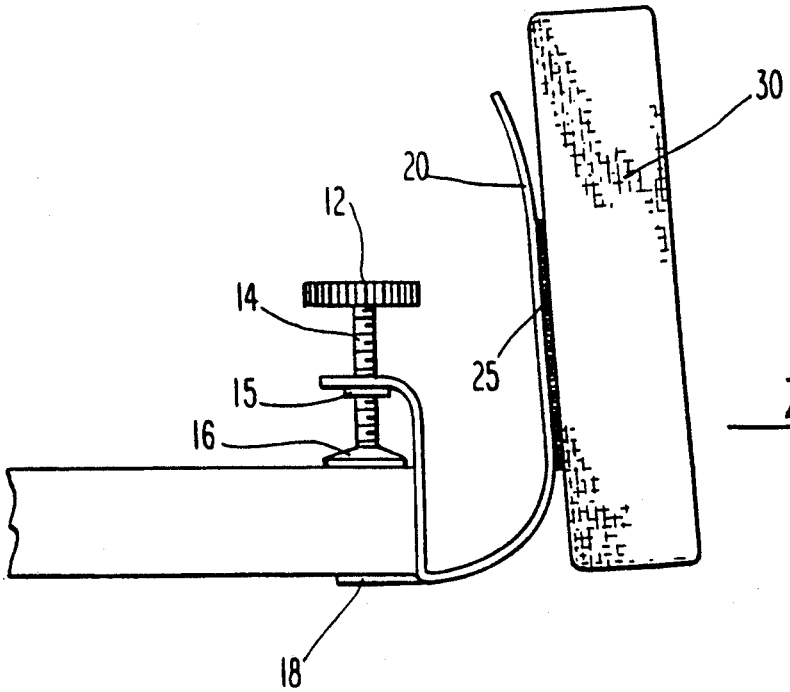
FIG. 3 illustrates a perspective view of a preferred embodiment installed on a work surface.

The clamp is comprised of a knob 12, threaded shaft 14 and base 16 as well as a retainer 15 for the shaft 14, and cutout lip 18. Turning briefly to FIG. 3, the embodiment is shown installed on the work surface. Lip 18 engages the work surface on the lower side and the upper side of the work surface is engaged by base 16 which has been finger tightened by knob 12. The knob 12 is plastic, while the threaded shaft 14, base 16, and retainer 15 are metal.

The spring member 20 is arranged generally in a U-shape and provides a backing for pad 30, as well as providing resiliency against the worker leaning against the pad. The pad 30 is attached to the spring member 20 at 25, by attached strips of a fabric type fastener such as Velcro® or the like. The spring member 20 and lip 18 is preferably spring steel, although any metal with sufficient resiliency is useable. The pad 30 is comprised of fabric covering a foam rubber base. It should be noted that the pad 30 could be fastened anywhere along the length of the spring member 20 because of the fabric type fastener, as long as sufficient fastener to make a secure connection is utilized.

Figure 4:
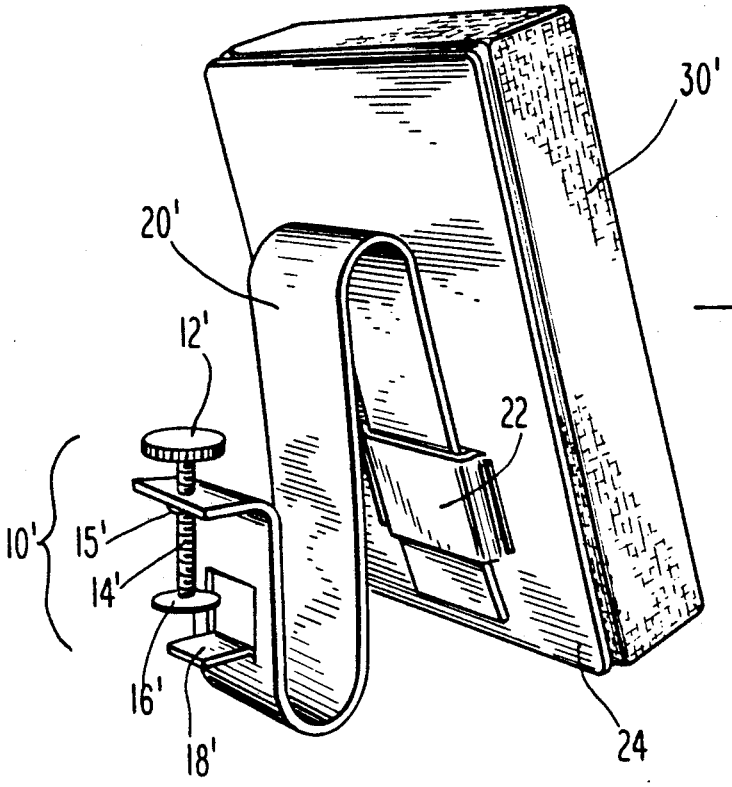
FIG. 4 illustrates a perspective view of another preferred embodiment.
Figure 5:
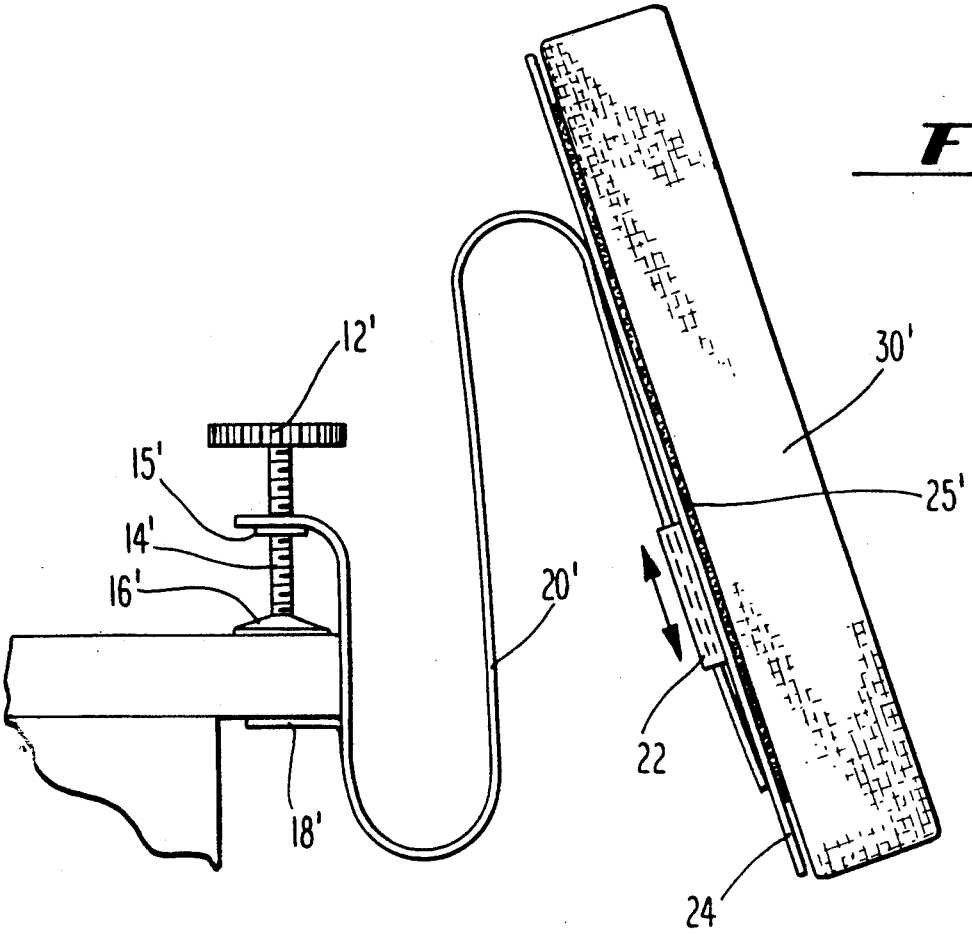
FIG. 5 illustrates the embodiment of FIG. 4 installed on a work surface.

Another embodiment is seen in perspective at FIG. 4 and attached to a work surface at FIG. 5. The clamp is shown generally at 10', and is comprised of a knob 12', threaded shaft 14', threaded retainer 15', base 16' and lip 18'. The spring member 20' is disposed generally in a single sinusoidal curve. Backer 24 is attached to spring member 20' through cleat 22. As seen in FIG. 5, the slight bowing of member 20' provides for offsetting tensions through contact with clamp 22 and the two other contacts of backer 24 with member 20. These contact points of member 20 with backer 24 permit the backer 24 to be adjusted upwardly and downwardly, as shown by the arrow in FIG. 5, in order to provide support where desired. The use of a fabric type fastener at 25' permits further adjustment, if desired, of pad 30' on backer 24, so long as sufficient contact of fastener is made to secure pad 30' on backer 24'. The materials utilized are the same as in the embodiment shown in FIGS. 1–3, and the backer 24 is comprised of the same metal for ease of manufacture as spring member 20, although it is not necessary for it to be so comprised.

Figure 6:
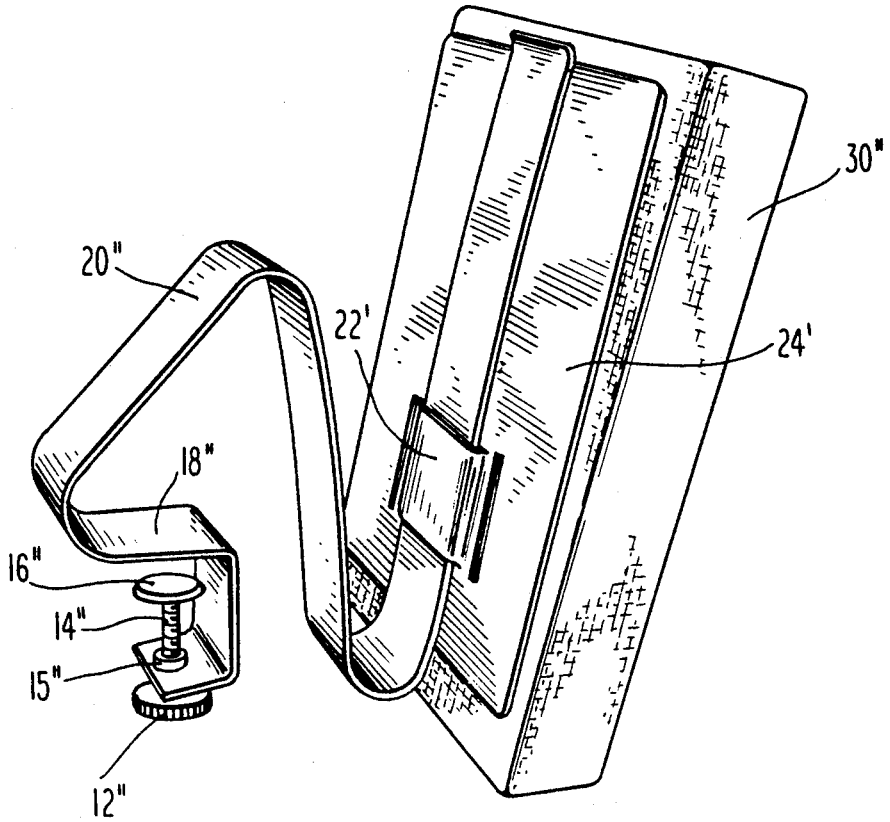
FIG. 6 illustrates a perspective view of another preferred embodiment.
Figure 7:
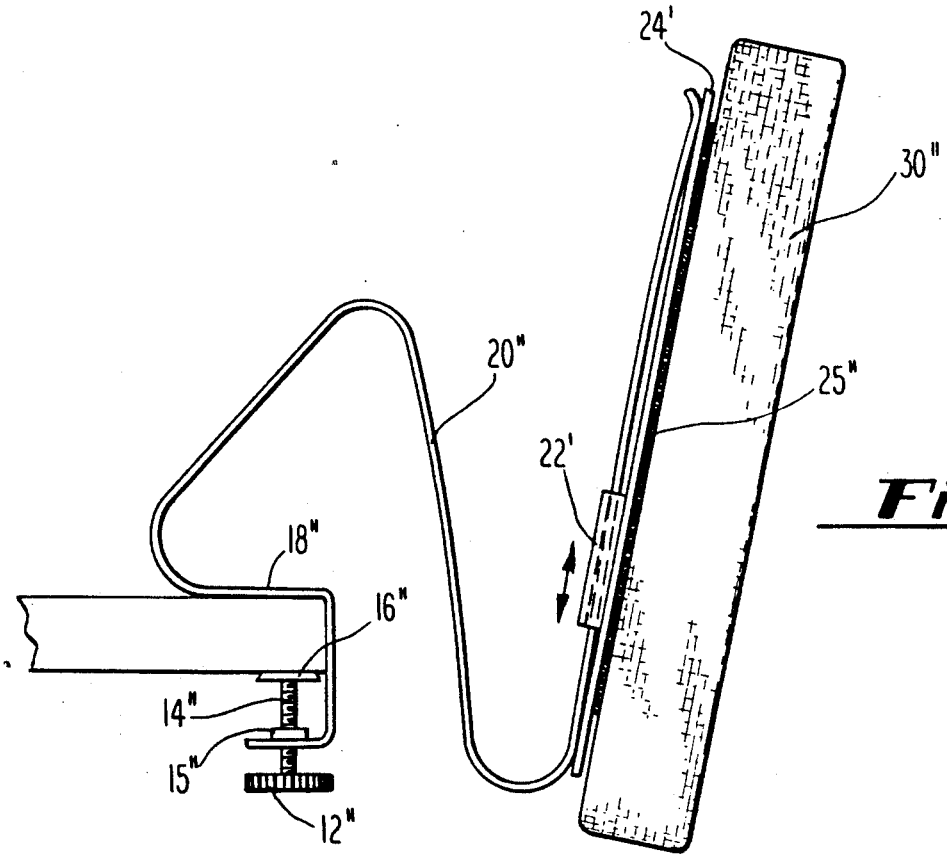
FIG. 7 illustrates the embodiment of FIG. 6 installed on a work surface.

At FIGS. 6 and 7 is seen yet another embodiment. The member 20'' is generally shaped sinusoidally. The clamping means shown generally at 10'' is comprised of knob 12'', threaded shaft 14'', retainer 15'' and base 16''. The work surface is retained between base 16'' and lip 18 as seen in FIG. 7. The materials utilized are the same as in the embodiment shown in FIGS. 4 and 5.

Also seen in FIG. 7, is backer 24', clamp 22, fastener 25 and pad 30''. The member 20'' contacts the backer 24 in a similar fashion to the embodiment of FIGS. 4 and 5. This provides for adjustment of the backer 24' and the pad 30'' in the direction of the arrow in FIG. 7.

It will be recognized by those skilled in the art that changes may be made to the above-described embodiments of the invention without departing from the broad inventive concepts thereof. It is understood, therefore, that this invention is not limited to the particular embodiments disclosed, but it is intended to cover all modifications which are within the scope and spirit of the invention as defined by the appended claims.

I claim:

1. A support for the body of a worker comprising;
a pad means for receiving a body portion thereon;
a spring means disposed in a generally linear manner and having a front end and a back end with said back end terminating in a clamp means; and,
a retaining means connected to said front end of said spring means for adjustably holding said pad means to said front end of said spring means.

2. A support as in claim 1 wherein said spring means is generally U-shaped.

3. A support as in claim 2 wherein said spring means is comprised of spring steel.

4. A support as in claim 1 wherein said spring means is generally sinusoidally shaped.

5. A support as in claim 4 wherein said spring means is comprised of spring steel.

6. A support as in claim 1 wherein said clamp means comprises a knob means, connected to a threaded shaft means, which in turn is connected to a base means, and a lip means.

7. A support as in claim 1, wherein said retaining means comprises a fastening means.

8. A support for a worker comprising;

a pad means;

a spring means disposed in a generally linear manner and having a front end and a back end with said back end terminating in a clamp means; and, a retaining means connected to said front end of said spring means for adjustably holding said pad means to said front end of said spring means, wherein said retaining means comprises; a backing means, and a fastening means wherein said pad means is adjustably connected to said fastening means, and said fastening means is connected to said backing means and said backing means is adjustably connected to said spring means.

* * * * *